US006579150B2

(12) United States Patent
Tseng

(10) Patent No.: US 6,579,150 B2
(45) Date of Patent: Jun. 17, 2003

(54) DUAL DETECTION METHOD FOR END POINT IN CHEMICAL MECHANICAL POLISHING

(75) Inventor: Tung-Ching Tseng, Shindian (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/899,408

(22) Filed: Jul. 5, 2001

(65) Prior Publication Data

US 2003/0008597 A1 Jan. 9, 2003

(51) Int. Cl.[7] ..... B24B 49/00
(52) U.S. Cl. ..... 451/6; 451/8; 451/41
(58) Field of Search ..... 451/6, 8, 5, 11, 451/41

(56) References Cited

U.S. PATENT DOCUMENTS 5,222,329 A * 6/1993 Yu ..... 451/10
5,439,551 A * 8/1995 Meikle et al. ..... 216/84
6,007,405 A * 12/1999 Mei ..... 438/692
6,010,538 A * 1/2000 Sun et al. ..... 156/345.13
6,106,662 A * 8/2000 Bibby et al. ..... 156/345.13
6,135,855 A * 10/2000 Vanell ..... 451/14
6,257,953 B1 * 7/2001 Gitis et al. ..... 451/287
6,319,094 B1 * 11/2001 Williams ..... 451/36
6,379,219 B1 * 4/2002 Oba ..... 451/286

* cited by examiner

*Primary Examiner*—Joseph J. Hail, III
*Assistant Examiner*—Hadi Shakeri
(74) *Attorney, Agent, or Firm*—Tung & Associates

(57) ABSTRACT

A dual detection method for end point in a chemical mechanical polishing process is described. The dual detection method utilizes both an optical detection device and an acoustical detection device. The acoustical detection device may also be used independently in certain applications without the optical detection device. The acoustical detection device determines an end point and stops the CMP process when a volume of the acoustical emission changes by at least 30% from its initial volume, or preferably changes by at least 50% from its initial volume.

13 Claims, 3 Drawing Sheets

DUAL DETECTION METHOD FOR END POINT IN CHEMICAL MECHANICAL POLISHING

FIELD OF THE INVENTION

The present invention generally relates to a method for end point detection in chemical mechanical polishing and more particularly, relates to a dual detection method for end point in chemical mechanical polishing by utilizing both an optical method and an acoustical method.

BACKGROUND OF THE INVENTION

In the fabrication of a semiconductor devices, such as silicon wafers, a variety of different semiconductor equipment and/or processing tools are utilized. One of those processing tools is used for polishing thin, flat semiconductor wafers to obtain a planarized surface. A planarized surface is highly desirable on a shadow trench isolation (STI) layer, on an inter-layer dielectric (ILD) or on an inter-metal dielectric (IMD) layer which are frequently used in modern memory devices. The planarization process is important since in order to fabricate the next level circuit, a high resolution lithographic process must be utilized. The accuracy of a high resolution lithographic process can only be obtained when the process is carried out on a substantially flat surface. The planarization process is therefore an important processing step in the fabrication of a semiconductor device.

A global planarization process can be carried out by a technique known as chemical mechanical polishing or CMP. The process has been widely used on ILD or IMD layers in fabricating modem semiconductor devices. A CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer while the wafer is kept off-center on the pad in order to prevent polishing a non-planar surface onto the wafer. The wafer itself is also rotated during the polishing process to prevent polishing a tapered profile into the wafer surface. The axis of rotation of the wafer and the axis of rotation of the pad are deliberately not co-linear, however, the two axes must be parallel. It is known that uniformity in wafer polishing by a CMP process is a function of pressure, velocity and concentration of the slurry used.

In a process for polishing a dielectric layer, the goal is to remove typography and yet maintain good uniformity across the entire wafer. The amount of the dielectric material removed informally between about 5000 Å and about 10,000 Å. The uniformity requirement for ILD or IMD polishing is very stringent since non-uniform dielectric films lead to poor lithography and resulting window etching or plug formation difficulties. The CMP process has also be applied to polishing metals, for instance, in tungsten plug formation and in embedded structures. A metal polishing process involves a polishing chemistry that is significantly different than that required for oxide polishing.

The important component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handle are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrolyzation reaction; the formation of hydrogen bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in end point detection. The CMP process is frequently carried out without a clear signal about when the process is completed by using only empirical polishing rates and timed polish. Since the calculation of polish time required based on empirical polishing rates is frequently inaccurate, the empirical method fails frequently resulting in serious yield drops. Attempts have been made to utilize in end point mechanism including those of capacitive measurements and optical measurements. However, none of these techniques have been proven to be satisfactory in achieving accurate control of the dielectric layer removed.

Another method for achieving end point detection is marketed by the Applied Materials Corporation of Santa Clara, Calif. In a MIRRA® CMP device. In the MIRRA® device, a system of in-situ remote monitor (ISRM) is provided to determine end point by the concept of a periodic change of optical interference. In the MIRRA® device, signals received from a patterned wafer surface are processed by digital filtering algorithms by a PC programmable filter such that an optical interference intensity changes periodically with the thicknesses of removed surface material. For instance, a built-in laser source which is fixed at 6700 Å wavelength is utilized to cause interference at a wafer surface and thus producing a waveform received by a laser detector. The waveform generated by such a technique is shown in FIG. 1. Similarly, a reflectance vs time curve obtained in a LAM® CMP apparatus is shown in FIG. 4.

FIG. 1 illustrates four cycles of a waveform with each cycle corresponds to a removed material layer thickness of approximately 2437 Å. The technique is adequate to detect an end point in a polishing process wherein only a relatively thin layer, for instance, of only 2000 Å is removed. When a large thickness of material such as an IMD oxide layer having a thickness of at least 4000 Å is to be removed, the method frequently produces faulty results since the laser detector cannot distinguish which one of the waveform cycles the end point falls on. The wafer surface can therefore be either over-polished or under-polished by 2400 Å thickness. For instance, FIG. 5A shows an over-polish condition of a present layer wherein Cu residue causes a short across metal lines, while FIG. 5B shows an over-polish of a previous layer under a present layer which leads to high resistance due to dishing/erosion, and furthermore, hard-to-remove Cu residue is left on the next layer.

U.S. Pat. No. 6,071,177, assigned to the common assignee of the present invention discloses a method and apparatus for determining end point in a chemical mechanical polishing process by utilizing a dual wavelength interference technique. The patent further discloses a method and apparatus for terminating a chemical mechanical polishing process conducted on a semiconductor wafer at a preset end point by utilizing a dual wavelength interference technique wherein the period, or a process window for detection is greatly expanded from that conventionally available of a single wavelength interference technique. For instance, instead of a process window of only 2400 Å (or a period between cycles in the waveform), the technique provides a window for detection of at least 4000 Å such that a greatly expanded detection range is provided. The method and apparatus may be utilized for detecting thickness of material removed from the surface of a semiconductor wafer of any thickness, but is particularly suitable for determining the thickness of material removed from a thick layer on a wafer surface.

In the method, a laser generating source which may include two semiconductor diodes each generating a laser emission at a different wavelength is utilized. For instance, a suitable set of laser emission wavelengths utilized is 4500 Å and 6700 Å, respectively. While any suitable sets of wavelength of laser emission may be utilized, it is desirable that an two different wavelength emissions produce an additive effect in the waveform obtained after an interference process between emissions reflected from the wafer surface. For instance, instead of a period or a process window of 2400 Å available from a single wavelength interference pattern obtainable conventional, the present invention dual wavelength interference technique may produce a period of at least 4000 Å, i.e., a window that is almost twice as wide as that available from the conventional single wavelengths interference technique. This provides the benefit of easy identification of an end point when a large thickness of dielectric material is removed.

The method provides an end point detection method for oxide CMP process which may be utilized in a planarization process for ILD, IMD or STI layers by the concept of periodic interference change. By using a method of a dual wavelength interference, the range or the process window for end point detection can be greatly expanded, i.e., by almost 100%. The present invention end point detection method therefore increases wafer throughout efficiency and achieves wafer cost reduction.

Based on the concept of periodic change of optical interferences, the method for end point detection utilizes a dual frequency laser emission source positioned in a rotating platform for a CMP process. Signals obtained from patterned wafer surface are processed through digital filtering algorithms in a PC programmable filter such that the interference intensity periodically changes with the thicknesses of the removed surface layer. For a built-in laser source having two semiconductor diodes at 4500 Å and 6700 Å wavelengths respectively, each cycle obtained in a composite waveform corresponds to a removed thickness of approximately 4000 Å. The present invention novel method therefore can be used to cover a wide range of dielectric layers including those of ILD, STI and IMD process windows.

U.S. Pat. No. 6,071,177 further shows, in FIG. 2, an apparatus 10 which has a polishing platen 12 that is intimately joined to a polishing pad 14 and is used as the rotating platen in the CMD apparatus. The rotating platen 12 is equipped with a laser generating source 20 which includes two semiconductor diodes (not shown) each capable of generating laser emissions at a different wavelength. For instance, as shown in FIG. 2, laser emissions 22 and 24 are each generated by a semiconductor diode at 4500 Å and 6700 Å, respectively.

Also shown in FIG. 2 is a semiconductor device 16 which consists of an oxide coating layer 18 overlying a base material layer 28. The base material layer 28 may be formed of any suitable materials, including but not limited to silicon, polysilicon and metal. The semiconductor water 16 is pressed onto the rotating platen 12 such that a top surface 32 of the oxide layer 18 intimately contacting and frictionally engaging a top surface 34 of the polishing pad 14. Laser emissions 22, 24 from the laser source 20 irradiating onto surface 32 of the oxide layer 18 through a window 40 provided in the polishing pad 14. This is also shown in a plane view of FIG. 3.

The laser emissions 22, 24 from the laser source 20 are partially reflected by the oxide surface 32 into reflected beams 36 and 38. Part of the laser beams 22, 24 penetrates into the oxide layer 18 and are reflected by the interface 50 formed between the oxide layer 18 and the base material layer 28. The reflected beams are then deflected at the oxide surface 32 into laser beams 56 and 58 to be received by the laser detector 30. An interference occurs between the deflected beams 36, 38 and the deflected beams 56, 58 when the beams are received by the detector 30 to thus producing a dual wavelength interference waveform 60 (shown in FIG. 4).

While the method provided in U.S. Pat. No. 6,071,177 works somewhat satisfactorily, there are several drawbacks in the conventional single wavelength interference method. For instance, the technique requires complicated equipment set up, i.e., dual laser sources and receivers, and furthermore, requires a high degree of training for the operator to operate the system. Moreover, when the window 40 shown in FIG. 2 is damaged, either broken or fractured, or simply covered with a slurry material, the efficiency of detection suffers greatly.

It is therefore an object of the present invention to provide a method for detecting an end point in a chemical mechanical polishing process that does not have the drawbacks or shortcomings of the conventional methods.

It is another object of the present invention to provide a method for detecting an end point in a chemical mechanical polishing process based on an acoustical detection principle.

It is a further object of the present invention to provide a method for detecting an end point in a chemical mechanical polishing process that does not rely solely on optical detection.

It is another further object of the present invention to provide a dual detection method for end point in chemical mechanical polishing wherein both an optical detection device and an acoustical detection device are utilized.

It is still another object of the present invention to provide a dual detection method for end point in chemical mechanical polishing that utilizes an acoustical sensing device such as a microphone.

It is yet another object of the present invention to provide a chemical mechanical polishing apparatus that is equipped an acoustical end point detection device without using an optical detection device.

It is still another further object of the present invention to provide a method for detecting an end point in a chemical mechanical polishing process by detecting a volume of the polishing acoustical signals and determining the end point when the volume decreases by at least 30% of its initial volume.

SUMMARY OF THE INVENTION

In accordance with the present invention, a dual detection method for end point in chemical mechanical polishing by utilizing both an optical detection device and an acoustical detection device is provided.

In a preferred embodiment, a method for detecting an end point in a chemical mechanical polishing process can be carried out by the operating steps of providing a CMP apparatus contained in an enclosure; mounting an acoustical sensor in the enclosure; initiating a CMP process on a semiconductor wafer for removing an uppermost coating layer; monitoring an acoustical signal generated by the CMP process and recording a volume of the signal; and stopping the CMP process when the volume of the acoustical signal changes by at least 30% of its initial volume.

The method for detecting an end point in a CMP process may further include the step of stopping the CMP process when the volume of the acoustical signal changes by at least 50% of its initial volume, or the step of stopping the CMP process when the volume of the acoustical signal decreases by at least 50% of its initial volume. The method may further include the step of stopping the CMP process when the volume of the acoustical signal decreases by at least 5 dB from its initial volume. The method may further include the step of mounting a microphone in the enclosure.

The present invention is further directed to a CMP apparatus that is equipped with an acoustical end point detection device which includes a polishing pad holder for holding a polishing pad thereon; means for rotating the polishing pad holder; a sample holder for holding a sample to be polished thereon; means for rotating and traversing the sample holder on the polishing platen; an enclosure for enclosing the polishing pad holder and the sample holder; and an acoustical sensor mounted in the enclosure for sensing acoustically an end point of the polishing process when a change in volume of at least 30% occurs.

In the CMP apparatus that is equipped with an acoustical end point detection device, the acoustical sensor may be a microphone. The acoustical sensor senses an end point of the CMP process when a change in volume of at least 50% occurs, or when a decrease in volume of at least 50% occurs. The acoustical sensor further senses an end point of the CMP process when at least a 5 dB drop in volume occurs. The CMP apparatus may be of the rotary type, or may be of the linear type.

The present invention is still further directed to a dual detection method for an end point in a chemical mechanical polishing process which can be carried out by the operating steps of providing a CMP apparatus that is contained in an enclosure, the CMP apparatus includes a polishing pad holder equipped with an optical projector and a sensor therein for projecting and receiving an optical signal to and from a surface of a sample that is being polished through a window in the polishing pad for determining an end point of the CMP process; mounting an acoustical sensor in the enclosure for sensing and recording an acoustical signal generated by the CMP process; initiating a CMP process on the sample for removing an uppermost coating layer; determining an end point of the CMP process upon the occurrence of at least one of the two events; the optical signal received from the sample surface being indicative of an interface between the uppermost coating layer and an underlying layer, and the acoustical signal generated by the CMP process changes by at least 30% of its initial value.

The dual detection method for an end point in a CMP process may further include the step of determining the end point of the CMP process when the acoustic signal produced by the CMP process changes by at least 50% of its initial value, or the step of determining the end point of the CMP process when the acoustical signal produced by the CMP process decreases by at least 50% of its initial value. The method may further include the step of determining the end point of the CMP process when the acoustical signal produced by the CMP process decreases by at least 5 dB from its initial value. The method may further include the step of projecting and receiving a laser beam to and from a surface of the sample, or the step of mounting an acoustical microphone in the enclosure. The CMP apparatus may either be a rotary type CMP, or a linear type CMP.

BRIEF DESCRIPTION OF THE DRAWINGS

These and other objects, features and advantages of the present invention will become apparatus from the following detailed description and the appended drawings in which.

DETAILED DESCRIPTION OF THE PREFERRED EMBODIMENT

The invention discloses a method for detecting an end point in a chemical mechanical polishing process by utilizing either an acoustical detection device alone, or a combination of an acoustical detection device and an optical detection device.

In the method for utilizing an acoustical detection device alone, the method can be carried out by first providing a CMP apparatus that is contained in an enclosure; mounting an acoustical sensor in the enclosure; initiating a CMP process on a semiconductor wafer for removing an uppermost coating layer; monitoring an acoustical emission generated by the CMP process and recording a volume of the emission; and stopping the CMP process when the volume of the acoustical emission changes by at least 30% of its initial volume. Preferably, the end point is taken as the point when the acoustical emission changes by at least 50% of its initial volume. In the preferred embodiment, the changes occurring in the acoustical emission as a Cu layer is polished away from a TaN layer results in an acoustical emission drop by at least 30% of its initial volume. However, in other different interfaces between different material layers, the acoustical emission volume may either increase or decrease by at least 30% when the interface is reached. The end point may further be determined when the acoustical emission volume changes by at least 5 dB from its initial volume. In other words, the acoustical emission volume may either go up by at least 5 dB or goes down by at least 5 dB. In most CMP processes, a total volume during polishing between about 25 dB and about 250 dB is normally detected.

The present invention method for determining end point in a chemical mechanical polishing process may further be carried out as a dual detection method by utilizing both an optical detection device and an acoustical detection device. Under such circumstances, the end point can be determined in the CMP process upon the occurrence of at least one of the two events of either when an optical signal received from the sample surface is indicative of an interface between the uppermost coating layer and an underlying layer, or the acoustical signal generated by the CMP process changes by at least 30% of its initial value.

The present invention novel method provides the benefit that it can be practiced either as an acoustical detection method alone, or practiced as a dual detection method in which the acoustical detection assures the accuracy of the optical detection method. For instance, when a window used for the optical detection is damaged or covered with slurry, the acoustical detection method detects the end point to alleviate any problem caused by the failed optical detection method.

Figure 1:
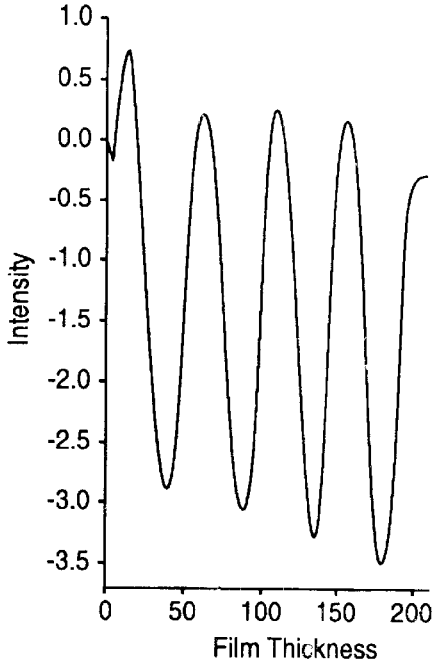
(PRIOR ART) FIG. 1
FIG. 1 is a graph illustrating an optical interference curve generated by a conventional single wavelength method.
Figure 3:
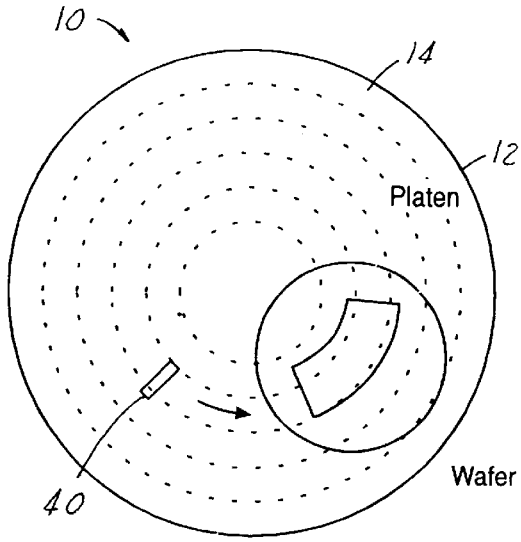
(PRIOR ART) FIG. 3
FIG. 3 is a plane view of the conventional apparatus with a sample positioned on a polishing platen and a window in the platen for laser emission.
Figure 2:
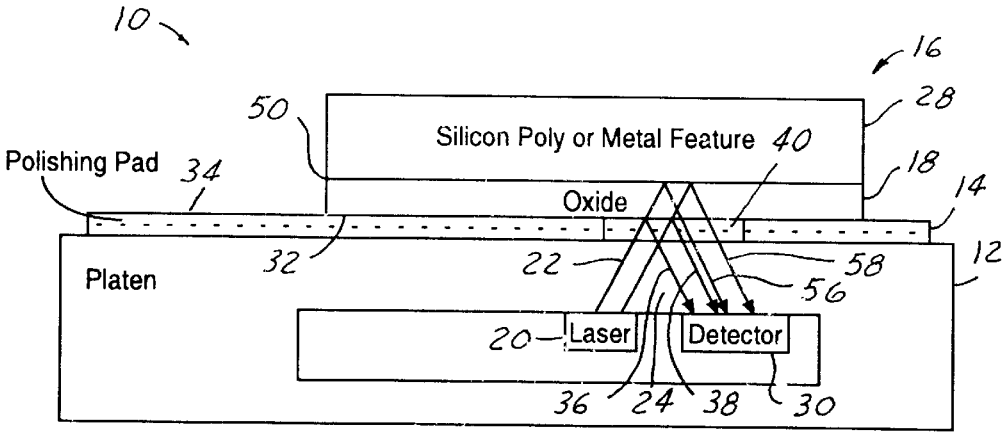
(PRIOR ART) FIG. 2
FIG. 2 is a cross-sectional view of a conventional apparatus wherein a platen is equipped with a laser source capable of generating laser emissions at two different wavelengths.
Figure 4:
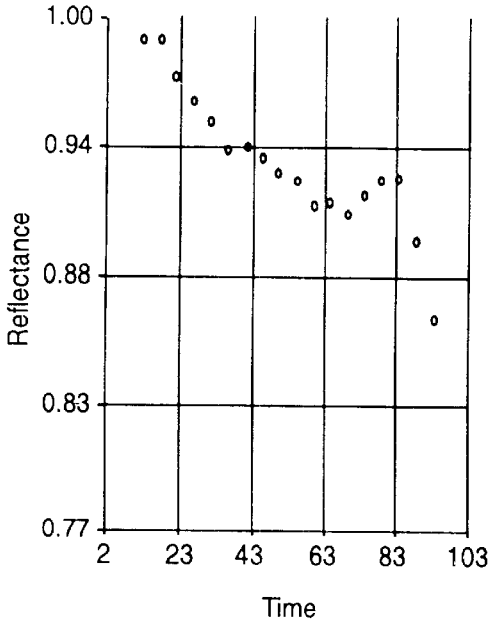
(PRIOR ART) FIG. 4
FIG. 4 is a graph produced by an optical end point detection device made by a commercial equipment supplier.
Figure 5A:
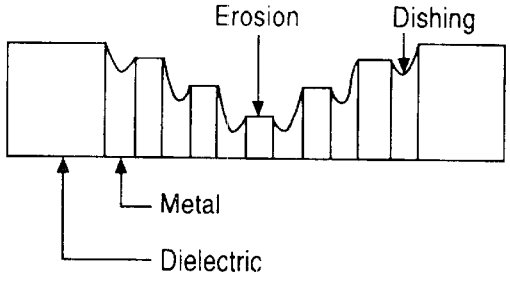
(PRIOR ART) FIG. 5A
FIG. 5A is an enlarged, cross-sectional view of a semiconductor device showing the effect of over-polish of a present layer.
Figure 5B:
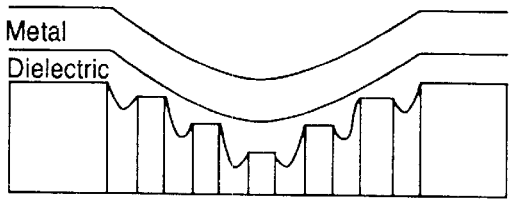
(PRIOR ART) FIG. 5B
FIG. 5B is an enlarged, cross-sectional view of a semiconductor device showing the effect of over-polish of a previous layer under a present layer.
Figure 6:
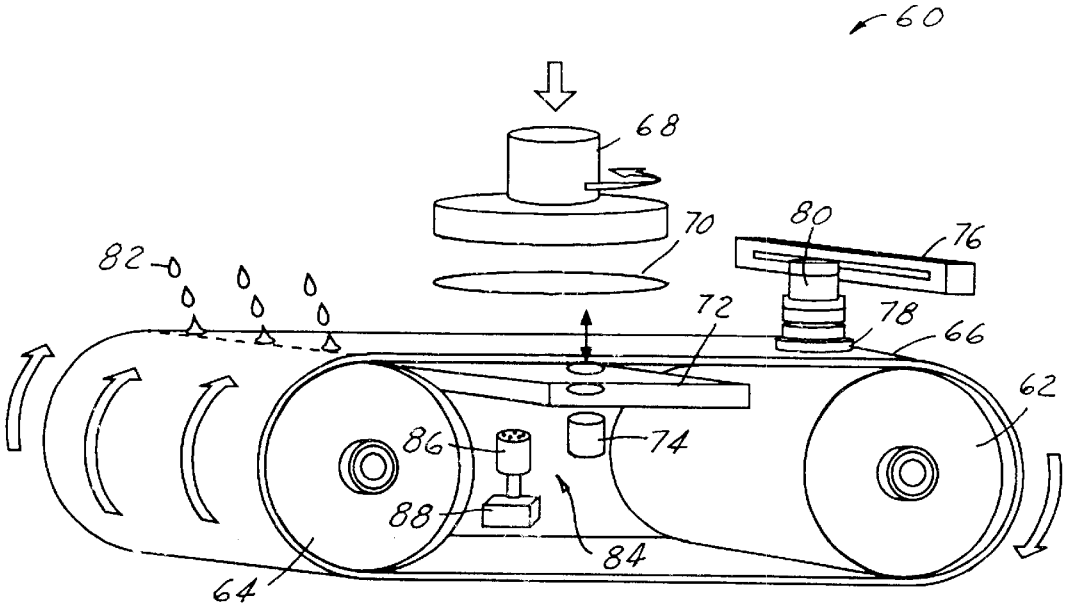
FIG. 6 is a perspective view of the present invention apparatus for acoustical end point detection mounted in a linear CMP apparatus.
Figure 7:
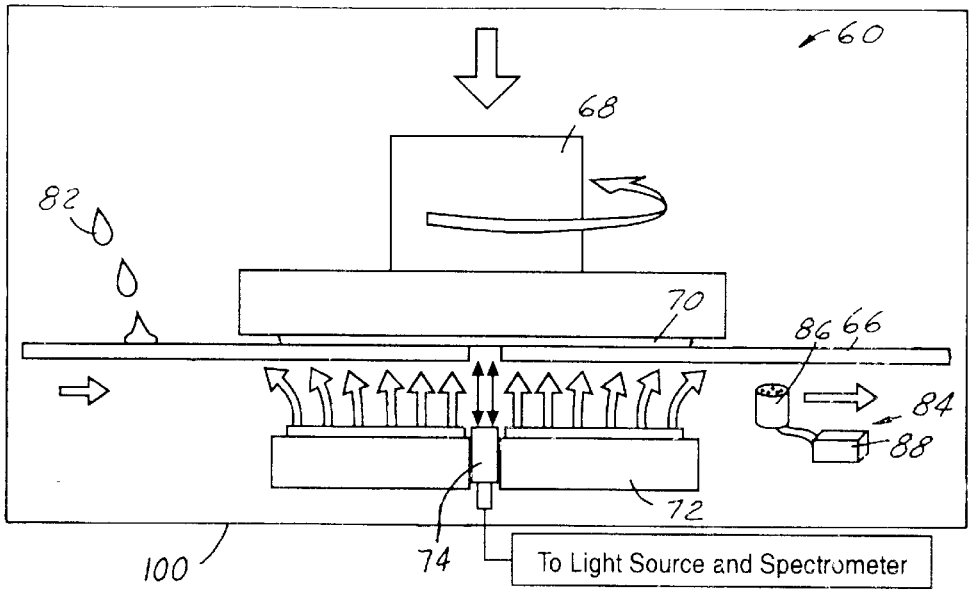
FIG. 7 is a side view of the present invention device of FIG. 6 with the polishing head engaging the linear polishing belt.
Figure 8:
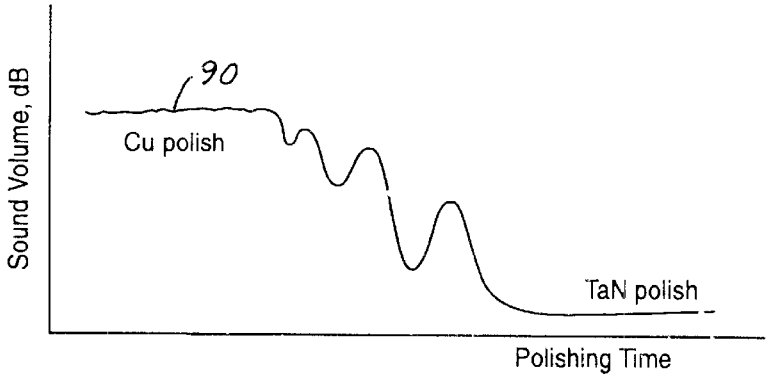
FIG. 8 is a graph illustrating the present invention method of monitoring volume of a polishing sound to determine end point by an acoustical sensor.

It should further be noted that, while the prior art shown in FIGS. 2 and 3 are illustrative examples of a rotary type CMP apparatus, the present invention embodiment shown in FIGS. 6, 7 and 8 are illustrative of linear-type CMP apparatus. The present invention novel method can be practiced in either type of CMP apparatus achieving the same desirable result as long as an acoustical sensing device can be mounted inside the enclosure 100 (shown in FIG. 7) for the CMP apparatus, i.e., adjacent to a polishing pad or polishing belt.

Referring now to FIG. 6, wherein a present invention apparatus 60 is shown. The apparatus 60 is of the linear-type CMP apparatus operated by two rotating rollers 62 and 64 that rotate in a clockwise direction. Onto the surfaces of the rollers 62, 64, is stretched a polishing belt with a polishing pad 66 mounted thereon. The rollers 62 and 64 are pushed apart at a suitable tension to keep the polishing pad 66 tightly stretched over the rollers. Situated over the polishing pad 66 is a polishing head 68 onto which a wafer 70 to be polished is mounted. Underneath the polishing pad 66, is mounted a support platen 72 for supporting the polishing pad 66 when the polishing head 68 is pushed down onto the pad surface. In the middle portion of the polishing pad 66, is provided a window (not shown) for an optical emission device 74 to project an optical emission therethrough for reflectance by the surface of the wafer 70. The optical detection method is similar to that shown in the prior art, and thus will not be described in detail.

On top of the polishing pad 66 is further provided a pad conditioner 76 which may include a conditioning pad 78 mounted on a conditioning head 80 for the conditioning of the polishing pad 66 during the polishing process. Slurry solution 82 is dispensed onto the polishing pad 66 by a slurry dispenser (not shown).

The present invention novel acoustical end point detection device 84, as shown in FIG. 6, consists of an acoustical sensing head 86 and a signal receiver/controller 88. The acoustical sensing head 86 may be suitably a microphone that has suitable sensitivity for monitoring acoustical emission signals during the polishing process and recording the signals by the signal receiver/controller 88.

A linear CMP polishing process is shown in FIG. 7. Note that window 88 provided through the polishing pad 66 is shown in FIG. 7. The polishing head 68 with the wafer 70 mounted thereon rotates and furthermore, traverses on the polishing pad 66 during the polishing process. The acoustical detection device 84 monitors and records an acoustical emission during the polishing process to produce trace 90 shown in FIG. 8.

It is seen in FIG. 8, that during the beginning pat of the polishing process on a Cu layer (coated on an adhesion layer of TaN), the sound volume is essentially constant when the copper is being removed. After a suitable polishing time has passed, i.e., between about 1 min. and about 10 min., the volume of acoustical emission in dB decreases through several downward steps to again reach a constant level. The several steps indicate an interface of Cu and TaN has been reached when islands of Cu still existed on the surface of the wafer until all Cu has been removed to reach the low plateau of the trace 90. In the preferred embodiment, a noticeable reduction in the sound volume, such as by at least 5 dB was noticed when the Cu layer is completely removed to reach the adhesion layer of TaN. However, as previously described, in other polishing operations, the sound volume may go up depending on the nature and type of the underlying material below the layer that is being removed.

The present invention novel method and apparatus for the dual detection of end point in a chemical mechanical polishing method utilizing both an optical detection device and an acoustical detection device have therefore been amply described in the above description and in the appended drawings of FIGS. 6, 7 and 8.

While the present invention has been described in an illustrative manner, it should be understood that the terminology used is intended to be in a nature of words of description rather than of limitation.

Furthermore, while the present invention has been described in terms of a preferred embodiments, it is to be appreciated that those skilled in the art will readily apply these teachings to other possible variations of the inventions.

The embodiment of the invention in which an exclusive property or privilege is claimed are defined as follows.

What is claimed is:

1. A chemical mechanical polishing apparatus for a polishing process generating an acoustical emission equipped with acoustical and optical end point detection devices comprising:

a polishing pad holder for holding a polishing pad thereon;

means for rotating said polishing pad holder;

a sample holder for holding a sample to be polished thereon;

means for rotating and traversing said sample holder on said polishing platen;

an enclosure for enclosing said polishing pad holder and said sample holder;

an optical projector and a sensor therein for projecting and receiving an optical signal to and from a surface of a sample being polished through a window in said polishing pad for determining an end point of said CMP process; and an acoustical sensor mounted in said enclosure for sensing acoustically an end point of the polishing process as the point when a change in the acoustical emission of at least 30% occurs.

2. A CMP apparatus equipped with an acoustical end point detection device according to claim 1, wherein said acoustical sensor is a microphone.

3. A CMP apparatus equipped with an acoustical end point detection device according to claim 1, wherein said acoustical sensor sensing an end point of the CMP process when a change in the acoustical emission of at least 50% occurs.

4. A CMP apparatus equipped with an acoustical end point detection device according to claim 1, wherein said acoustical sensor sensing an end point of the CMP process when a decrease in the acoustical emission of at least 50% occurs.

5. A CMP apparatus equipped with an acoustical end point detection device according to claim 1, wherein said accoustical sensor sensing an end point of the CMP process when a 5 dB drop in accoustical emission occurs.

6. A CMP apparatus equipped with an acoustical end point detection device according to claim 1, wherein said CMP apparatus is of a linear type.

7. A dual detection method for an end point in a chemical mechanical polishing (CMP) process comprising the steps of:

providing a CMP apparatus contained in an enclosure, said CMP apparatus comprises a polishing pad holder equipped with an optical projector and a sensor therein for projecting and receiving an optical signal to and from a surface of a sample being polished through a window in said polishing pad for determining an end point of said CMP process;

mounting an acoustical sensor in said enclosure for sensing and recording an acoustical signal generated by said CMP process;

initiating a CMP process on said sample for removing an uppermost coating layer;

determining an end point of the CMP process upon the occurrence of at least one of the two events;

the optical signal received from said sample surface being indicative of an interface between said uppermost coating layer and an underlying layer; and the accoustical emission generated by said CMP process changes by at least 30% of its initial value.

8. A dual detection method for an end point in a CMP process according to claim 7 wherein when said acoustical emission change occurs first, further comprises the step of determining the end point of the CMP process when said acoustical signal produced by said CMP process changes by at least 50% of its initial value.

9. A dual detection method for an end point in a CMP process according to claim 7 wherein when said acoustical emission change occurs first, further comprises the step of determining the end point of the CMP process when said acoustical signal produced by said CMP process decreases by at least 50% of its initial value.

10. A dual detection method for an end point in a CMP process according to claim 7 wherein when said acoustical emission change occurs first, further comprises the step of determining the end point of the CMP process when said acoustical signal produced by said CMP process decreases by at least 5 dB from its initial value.

11. A dual detection method for an end point in a CMP process according to claim 7 further comprising the step of projecting and receiving a laser beam to and from a surface of said sample.

12. A dual detection method for an end point in a CMP process according to claim 7 wherein when said acoustical emission change occurs first, further comprises the step of mounting an acoustical microphone in said enclosure.

13. A dual detection method for an end point in a CMP process according to claim 7 wherein said CMP apparatus is a linear CMP.

* * * * *